US006990826B1

(12) United States Patent
Lifson et al.

(10) Patent No.: US 6,990,826 B1
(45) Date of Patent: Jan. 31, 2006

(54) SINGLE EXPANSION DEVICE FOR USE IN A HEAT PUMP

(75) Inventors: Alexander Lifson, Manlius, NY (US); Michael F. Taras, Fayetteville, NY (US)

(73) Assignee: Carrier Corporation, Farmington, CT (US)

( * ) Notice: Subject to any disclaimer, the term of this patent is extended or adjusted under 35 U.S.C. 154(b) by 0 days.

(21) Appl. No.: 11/098,845

(22) Filed: Apr. 5, 2005

(51) Int. Cl.
*F25B 13/00* (2006.01)

(52) U.S. Cl. ..... 62/324.1; 62/160; 62/222

(58) Field of Classification Search ..... 62/324.1, 62/160, 324.6, 189, 200, 222; 165/62
See application file for complete search history.

(56) References Cited

U.S. PATENT DOCUMENTS 4,420,947 A * 12/1983 Yoshino ..... 62/160

5,265,434 A * 11/1993 Alsenz ..... 62/117

* cited by examiner

*Primary Examiner*—Melvin Jones
(74) *Attorney, Agent, or Firm*—Carlson, Gaskey & Olds

(57) ABSTRACT

A heat pump is provided with a single expansion device a pair of four-way reversing valves. One of the reversing valves routes the refrigerant from the compressor to either an outdoor heat exchanger or indoor heat exchanger, as well as routes the refrigerant back to the compressor. The second four-way reversing valve receives refrigerant from one of the heat exchangers and properly routes it through a common expansion device in a single direction. The two four-way reversing valves are controlled dependent on whether the heat pump is operating in a cooling or heating mode. A single expansion device sensor is positioned on a suction line, which receives refrigerant on its way back to the compressor from the first four-way reversing valve. The present invention thus eliminates the prior art requirement of additional components, enhances control and reduces system cost.

11 Claims, 1 Drawing Sheet

COOLING
HEATING

COOLING
HEATING

SINGLE EXPANSION DEVICE FOR USE IN A HEAT PUMP

BACKGROUND OF THE INVENTION

This application relates to a heat pump having a single expansion device coupled with a flow control device to properly route the refrigerant through the single expansion device dependent upon whether the heat pump is operating in a cooling mode or in a heating mode.

Refrigerant systems are utilized to control the temperature and humidity of air in various indoor environments to be conditioned. In a typical refrigerant system operating in the cooling mode, a refrigerant is compressed in a compressor and delivered to a condenser (or an outdoor heat exchanger in this case). In the condenser, heat is exchanged between outside ambient air and the refrigerant. From the condenser, the refrigerant passes to an expansion device, at which the refrigerant is expanded to a lower pressure and temperature, and then to an evaporator (or an indoor heat exchanger). In the evaporator, heat is exchanged between the refrigerant and the indoor air, to condition the indoor air. When the refrigerant system is operating, the evaporator cools the air that is being supplied to the indoor environment. In addition, as the temperature of the indoor air is lowered, moisture usually is also taken out of the air. In this manner, the humidity level of the indoor air can also be controlled.

The above description is of a refrigerant system being utilized in a cooling mode of operation. In the heating mode, the refrigerant flow through the system is essentially reversed. The indoor heat exchanger becomes the condenser and releases heat into the environment to be conditioned (heated in this case) and the outdoor heat exchanger serves the purpose of the evaporator and exchangers heat with a relatively cold outdoor air. Heat pumps are known as the systems that can reverse the refrigerant flow through the refrigerant cycle, in order to operate in both heating and cooling modes. This is usually achieved by incorporating a four-way reversing valve (or an equivalent device) into the system schematic downstream of the compressor discharge port. The four-way reversing valve selectively directs the refrigerant flow through indoor or outdoor heat exchanger when the system is in the heating or cooling mode of operation respectively. Typically, a pair of expansion devices, each along with a check valve, is employed.

One problem with the prior art heat pumps is the complexities associated with the provision of the expansion function. Since in the heat pumps the refrigerant will flow in opposed directions (depending on the mode of operation), it has been difficult to provide a single adequate expansion device. Additionally, since the requirements of enhanced reliability and improved control recently became one of the essential issues in the industry, thermal expansion devices are now frequently found in applications where fixed orifice expansion devices used to be a standard.

Another approach is disclosed in co-pending U.S. patent application Ser. No. 10/693,93, owned by the assignee of the present invention. In this concept, a single expansion device is utilized with a movable plunger that is moved to the appropriate position, depending on the mode of operation.

Another approach is to utilize an electronic expansion valve. However, electronic expansion valves are expensive and require additional electronics and sensors.

SUMMARY OF THE INVENTION

In a disclosed embodiment of this invention, there is a refrigerant system utilized as a heat pump, and incorporating a first four-way reversing valve for properly routing the refrigerant from the compressor to the indoor and outdoor heat exchangers. A second four-way valve routes refrigerant between the two heat exchangers in the appropriate direction through a single expansion device. A TXV (thermal expansion valve) bulb is positioned downstream of the first four-way reversing valve on a suction line leading to the compressor. Thus, regardless of the refrigerant flow direction, the TXV bulb will be adequately monitoring the refrigerant characteristics at the compressor suction, and properly controlling and communicating back to the expansion device. Further, the second four-way reversing valve is ensuring that the refrigerant is flowing in the appropriate direction through the expansion device. A control for the system would switch the two four-way reversing valves to the appropriate position, and control the expansion device based upon the refrigerant as sensed by the TXV bulb.

The present invention thus provides a heat pump, which is more reliable, less expensive, and easier to manufacture due to the elimination of additional components. Furthermore, an enhanced control is provided.

These and other features of the present invention can be best understood from the following specification and drawings, the following of which is a brief description.

DETAILED DESCRIPTION OF THE PREFERRED EMBODIMENT

In a conventional TXV, a bulb senses a refrigerant condition upstream of the compressor and downstream of the evaporator. This bulb communicates back with the TXV plunger and controls the degree of opening of the TXV port. A TXV is much less expensive than an electronic expansion device and provides improved control over fixed orifice expansion device, however, as mentioned below, in heat pumps to date, two of these TXVs typically have been required.

Figure 1:
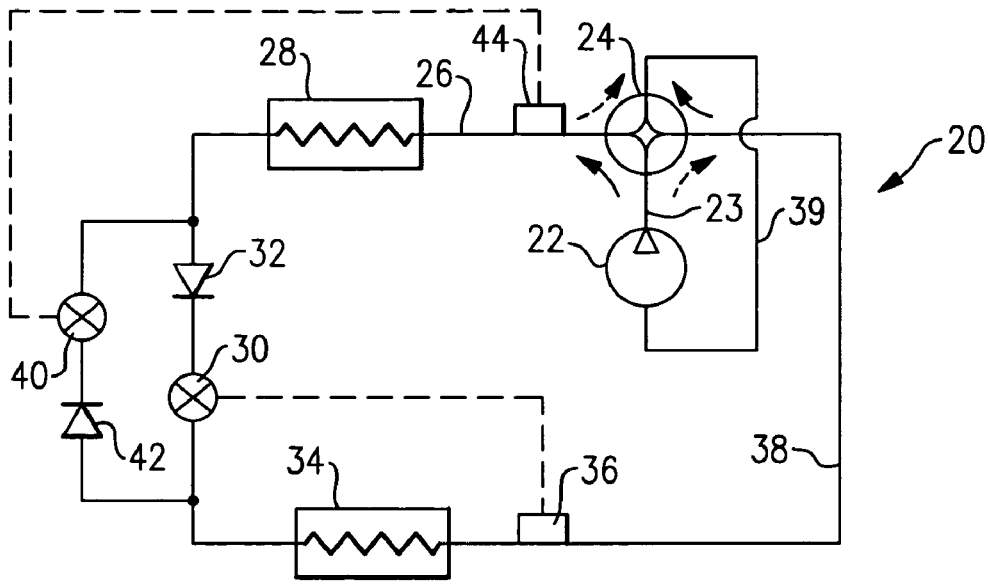
FIG.1 Prior Art
FIG. 1 is a schematic view of a prior art refrigerant system.

FIG. 1 shows a prior art refrigerant system 20 incorporating a compressor 22 compressing a refrigerant and delivering that refrigerant to a discharge line 23. A four-way reversing valve 24 is positioned to receive refrigerant from the discharge line 23 and route the refrigerant to a heat exchanger, as appropriate. Should the refrigerant system be operating in a cooling mode, the refrigerant will be initially directed to an outdoor heat exchanger 28 through a line 26. The refrigerant would then flow through a check valve 32 and a cooling thermal expansion device 30 to the indoor heat exchanger 34. A cooling TXV bulb 36 would monitor the conditions on a line 38 downstream of the indoor heat exchanger 34 to ensure that the cooling thermal expansion device 30 is controlled to deliver refrigerant to a compressor suction port with desired superheat values.

The line 38 leads back to the first four-way valve 24 and the refrigerant is routed back through a suction line 39 to the compressor 22. Should the four-way reversing valve 24 be moved to the opposite position such that the heat pump 20 is operating in heating mode, the refrigerant would flow from the discharge line 23 into the line 38, through the indoor heat exchanger 34, through a check valve 42, a heating thermal expansion device 40, the outdoor heat exchanger 28, and back through the four-way reversing valve 24 to the line 39. Again, a TXV bulb 44 would sense the conditions on the line 39 and can control the heating thermal expansion device 40 as appropriate to ensure desired conditions at the compressor suction.

It has to be understood that a simplified schematic of the prior art cycle presented in FIG. 1 does not cover a vast variety of different arrangements and system configurations. Additional components such suction accumulators, refrigerant storage receivers, refrigerant distribution devices, refrigerant-side economizers, reheat coils, auxiliary heat exchangers, etc. may be incorporated in the system design.

While the prior art does provide a wide variety of cooling and heating applications, it requires additional components. Namely, two distinct thermal expansion valves, two distinct check valves and two distinct bulbs are required.

Figure 2:
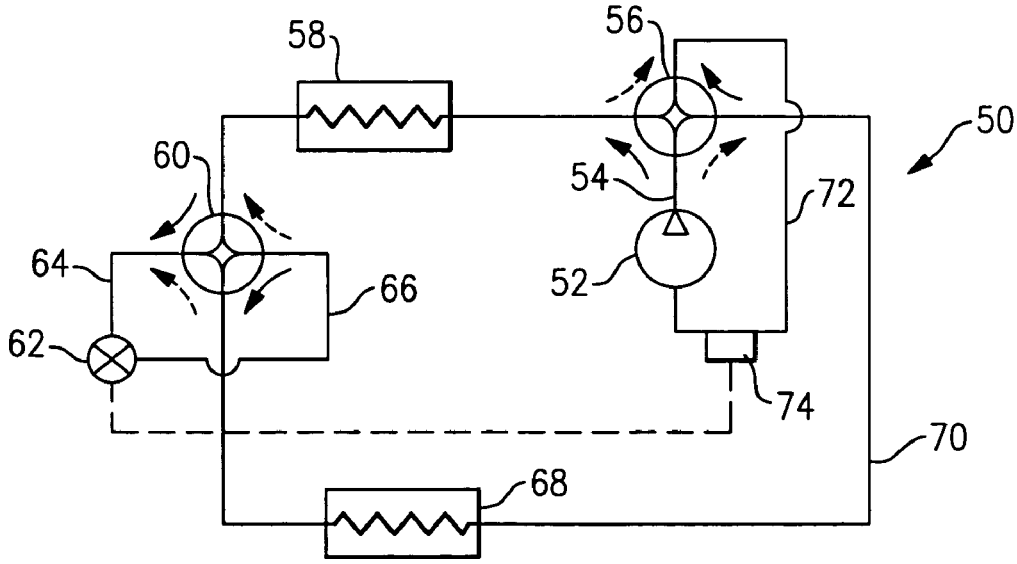
FIG. 2 shows the inventive refrigerant system.

The present invention is illustrated in FIG. 2. In this Figure, a heat pump 50 is shown having a compressor 52 delivering a compressed refrigerant to a discharge line 54. A first four-way reversing valve 56 is positioned to route the refrigerant from the line 54 selectively to one of an outdoor heat exchanger 58 or an indoor heat exchanger 68. In a cooling mode, the refrigerant would pass through the four-way reversing valve 56 to the outdoor heat exchanger 58, and to a second four-way reversing valve 60. The refrigerant, from the second four-way reversing valve 60, would be routed into a line 64 leading to a single expansion device 62. Downstream of the expansion device 62, the refrigerant passes through a line 66, back through the second four-way reversing valve 60, and to the indoor heat exchanger 68. Refrigerant passes from the indoor heat exchanger 68, to a line 70 leading back to the first four-way reversing valve 56. The first four-way valve 56 will route this refrigerant into the line 72, where it returns to the compressor 52. A single TXV bulb 74 is positioned on the line 72 and can control and communicate back to the thermal expansion device 62.

Should the refrigerant system be operated in a heating mode, the operation of the two four-way reversing valves 56 and 60 is reversed. Refrigerant would now pass from the line 54 into the line 70, through the indoor heat exchanger 68, to the four-way reversing valve 60. Refrigerant would be routed from the four-way reversing valve 60 through a line 64, single thermal expansion device 62, line 66, back through the four-way reversing valve 60 to the outdoor heat exchanger 58, and back to the first four-way reversing valve 56. The refrigerant would flow through the first four-way reversing valve 56 to the line 72, and back to the compressor 52.

The present invention thus provides a heat pump function, and provides a very reliable and simple way of providing the expansion function without requiring at least two separate expansion devices, two check valves and two bulbs.

Although a preferred embodiment of this invention has been disclosed, a worker of ordinary skill in this art would recognize that certain modifications would come within the scope of this invention. For that reason, the following claims should be studied to determine the true scope and content of this invention.

What is claimed is:

1. A beat pump comprising:

a compressor, an outdoor heat exchanger and an indoor heat exchanger, and a first flow control device for selectively routing refrigerant from said compressor to said outdoor heat exchanger when said heat pump is operating in a cooling mode, and for routing refrigerant to said indoor heat exchanger when said heat pump is operating in a heating mode, refrigerant flowing from either of said indoor and said outdoor heat exchangers to a second flow control device, and said second flow control device being positioned to receive refrigerant from said outdoor heat exchanger when said heat pump is operating in a cooling mode, and from said indoor heat exchanger when said heat pump is operating in a heating mode, and route said refrigerant through a common expansion device, refrigerant passing through said common expansion device and back through said second flow control device to said indoor heat exchanger when said heat pump is operating in said cooling mode, and to said outdoor heat exchanger when said heat pump is operating in said heating mode, said refrigerant then passing through said first flow control device and back to said compressor;

a suction line receives refrigerant from said first flow control device and delivers said refrigerant to a suction port of said compressor and wherein an expansion device sensor is placed on said suction line, said expansion device sensor communicating with said common expansion device.

2. The heat pump as set forth in claim 1, wherein said common expansion device is a thermal expansion valve, and said expansion device sensor is a bulb.

3. The heat pump as set forth in claim 1, wherein said common expansion device is a thermal expansion valve.

4. The heat pump as set forth in claim 1, wherein each of said second flow control device and said first flow control device functions are both provided by the same type flow control device.

5. The heat pump as set forth in claim 4, wherein said first valve is a four-way reversing valve and said second valve is a four-way reversing valve.

6. A method of operating a heat pump comprising the steps of:

(1) providing a compressor, an outdoor heat exchanger and an indoor heat exchanger, and a first flow control device for selectively routing refrigerant from said compressor to said outdoor heat exchanger when said heat pump is operating in a cooling mode, and for routing refrigerant to said indoor heat exchanger when said heat pump is operating in a heating mode, refrigerant flowing from either of said indoor and said outdoor heat exchangers to a second flow control device, and said second flow control device being positioned to receive refrigerant from said outdoor heat exchanger when said heat pump is operating in a cooling mode, and from said indoor heat exchanger when said heat pump is operating in a heating mode, and route said refrigerant through a common expansion device, refrigerant passing through said common expansion device and back through said second flow control device to said indoor heat exchanger when said heat pump is operating in said cooling mode, and to said outdoor heat exchanger when said heat pump is operating in said heating mode, said refrigerant passing through said first flow control device and back to said compressor;

(2) determining whether to operate said heat pump in a cooling mode or heating mode; and (3) positioning said first and said second flow control devices based upon said determination of step (2).

7. The method of operating a heat pump as set forth in claim 6, further comprising the steps of providing a suction line for receiving refrigerant from said first flow control device and delivering said refrigerant to a suction port on said compressor, and wherein an expansion device sensor is placed on said suction line, said expansion device sensor communicating with said common expansion device.

8. The method as set forth in claim 7, wherein said common expansion device is a thermal expansion valve, and said expansion device sensor is a bulb.

9. The method as set forth in claim 6, wherein said common expansion device is a thermal expansion valve.

10. The method as set forth in claim 6, wherein said second flow control device is provided by a single valve and said first flow control device is provided by the same type valve.

11. The method as set forth in claim 10, wherein said first valve is a four-way reversing valve and said second valve is a four-way reversing valve.

* * * * *